United States Patent [19]

Franzen

[11] 4,334,404

[45] Jun. 15, 1982

[54] TWO-FOR-ONE TWISTING SPINDLE WITH A SUPPLY RECEPTACLE FOR A LUBRICANT

[75] Inventor: Gustav Franzen, Willich, Fed. Rep. of Germany

[73] Assignee: Palitex Project-Company GmbH, Krefeld, Fed. Rep. of Germany

[21] Appl. No.: 173,668

[22] Filed: Jul. 29, 1980

[30] Foreign Application Priority Data

Aug. 2, 1979 [DE] Fed. Rep. of Germany ..... 2931391

[51] Int. Cl.[3] ..... D01H 13/30; D01H 7/86

[52] U.S. Cl. ..... 57/296; 57/58.83

[58] Field of Search ..... 57/58.49, 58.83, 295, 57/296, 298, 58.7

[56] References Cited

U.S. PATENT DOCUMENTS

| | | | |
|---|---|---|---|
| 2,932,396 | 4/1960 | Landolt | 57/58.83 |
| 3,295,306 | 1/1967 | Rehn | 57/296 X |
| 3,983,685 | 10/1976 | Scherf et al. | 57/296 |
| 4,023,337 | 5/1977 | Speranzin | 57/296 |

FOREIGN PATENT DOCUMENTS 1283132 7/1969 Fed. Rep. of Germany .

*Primary Examiner*—John Petrakes

[57] ABSTRACT

There is described a two-for-one twisting spindle having a supply receptacle for a lubricant arranged in a base of a protective pot, a region of an outer circumferential surface, of the protective pot, over which the revolving thread passes when the spindle is operating, communicating with the supply receptacle in such a way that lubricant is brought to the said region of the circumferential surface. Thereby the supply receptacle is in a stationary part of the spindle, so that lubricant content in the receptacle has no inertial effect on the running of the spindle. The arrangement enables consistent but not excessive wetting to be provided for the thread without the thread being subjected to undesirable stresses while the spindle is operating. In the arrangement shown, a protective pot 4 has a sidewall 5, over which thread 16 passes when the spindle is operating, and a base 7 having a cavity holding a supply of lubricant 10. Projecting into this cavity is an annulus 11 of absorbent material or material having a capillary structure, this annulus 11 extending through a circumferential slotted opening 15, whereby the thread fed past the outside edge of the annulus is wetted.

4 Claims, 2 Drawing Figures

TWO-FOR-ONE TWISTING SPINDLE WITH A SUPPLY RECEPTACLE FOR A LUBRICANT

Figure 1:
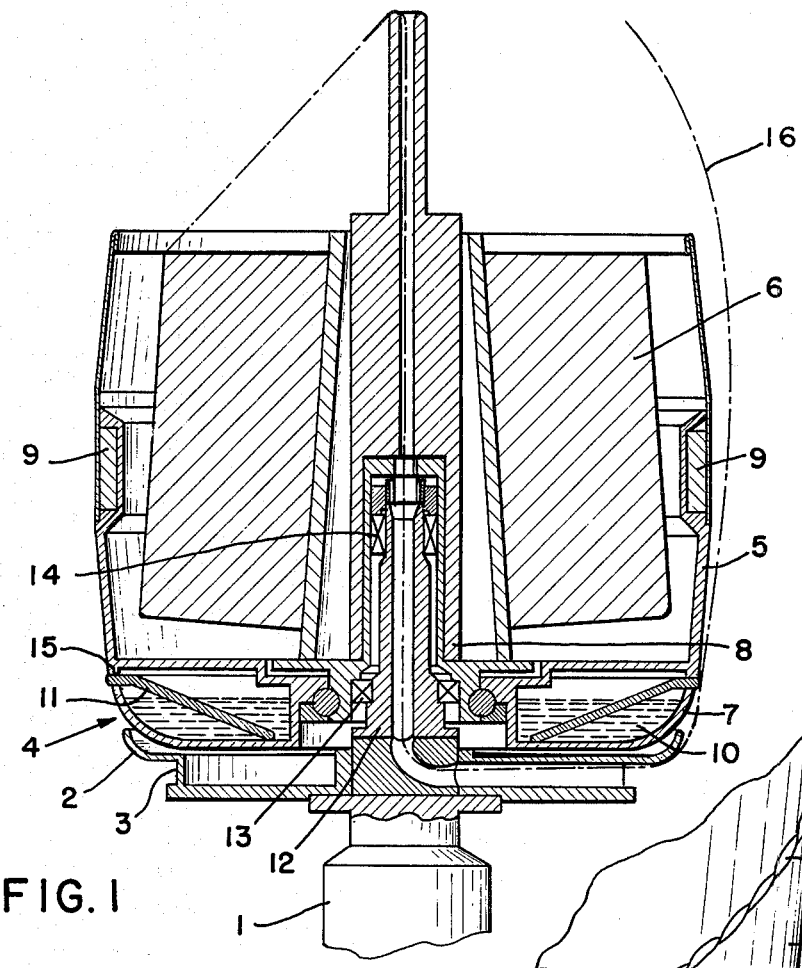

The invention relates to a two-for-one twisting spindle having a supply receptacle for a lubricant arranged in the region of a protective pot, which latter comprises a sidewall, a base and a hollow hub. The application of lubricants, a term also covering for example aviving or reviving agents, serves to improve the sliding characteristics of the thread during twisting and further processing and to keep it supple so as to prevent breakages and the production of fluff to a large extent.

From German Patent Specification No. 1 283 132 it is known to place on the base of a support for a supply package in a two-for-one twisting spindle a disc-shaped body of absorbent, resiliently compressible material which is soaked with a lubricant or wetting agent, in such way that the bottom end face of a package of thread inserted on the spindle rests on the lubricant-impregnated, disc-shaped body. What is achieved by these known measures is that individual sections of thread are wetted with lubricant and as the thread runs out, this lubricant becomes distributed along the entire length of the thread by virtue of the fact that as the thread runs past thread controlling members or thread guiding surfaces, it passes the quantities of lubricant which are present locally to the thread controlling members, with the result that a film of lubricant is able to form on the members and can be passed from them to the sections of thread which have not been wetted previously. However, this process necessarily means that the amount of lubricant picked up by the thread varies from section to section, i.e. is not consistent.

German Auslegeschrift No. 1 510 521 discloses a two-for-one twisting spindle having a supply receptacle for a lubricant or wetting agent, in which single or multiple thread to be twisted coming from a supply package or packages is subject to wetting. In the case of this two-for-one twisting spindle a supply receptacle for the lubricant or wetting agent, of which an outer or inner face is touched by the thread, is arranged in the region occupied by an outer balloon of thread and is provided with narrow apertures which run from the interior of the receptacle to the surface over which the thread runs. In one embodiment, provision is made for a supply receptacle of annular configuration for the lubricant or wetting agent to be arranged inside a rotating overrun body or plate, so that the entire receptacle and the quantity of lubricant or wetting agent situated in it all times rotate with the spindle, which on the one hand may cause imbalance when the spindle is running up and which on the other hand produces greater inertial forces when the spindle is running in the normal way.

The configuration of the rotor of a two-for-one twisting spindle has a critical effect on the formation of a balloon of thread. With most of the two-for-one twisting spindles on the market the preference is to form a balloon which either runs around the carrier for a supply package, i.e. around a protective pot without restraint or else which is supported on the outside by an anti-ballooning device. There are however two-for-one twisting spindles which, due to the configuration of their rotors, will not allow a balloon to form of a greater diameter than the outside of a carrier for the supply package i.e. the sidewall of the protective pot. In this case the balloon of thread slides over the carrier for the supply package i.e. the sidewall of the protective pot, for an appropriate distance vertically, i.e. the balloon of thread is supported on the inside by the sidewall of the protective pot of the carrier for the supply package. At a certain height the balloon of thread breaks away from the sidewall of the protective pot and then becomes an unrestrained balloon. This balloon can then once again increase to a size where it has to be restrained by an external anti-ballooning device (see for example Swiss Patent Specification No. 319 182). It is more difficult to support a balloon of thread from the inside than it is from the outside. The path followed by the thread when supported from the inside is not a straight or only slightly oblique line but, where the support for the balloon is from the inside, a spiral loop is formed around the outer circumference of the carrier for the supply package, i.e. the sidewall of the protective pot. The circumstance is connected with the double ballooning which automatically occurs which rotors of the configuration in question. This produces the disadvantage that where the balloon is supported on the inside, the thread is subject to greater tension due to the greater pressure against the carrier for the supply package, i.e. against the sidewall of the protective pot and due to the rope friction effect which is also porduced by the double ballooning.

The object of the invention is to provide a two-for-one twisting spindle, with inside support for a thread balloon, such as to enable consistent but not excessive wetting to be provided for the thread without the thread being subjected to undesirable stresses while the spindle is operating.

To achieve this object, a two-for-one twisting spindle according to the invention is characterized in that the supply receptacle for the lubricant is arranged in the base of the protective pot and in that a region of the outer circumferential surface of the protective pot over which the revolving thread passes when the spindle is operating communicates with the supply receptacle in such a way that the lubricant is brought to the said region of the circumference. To make the inside supporting surface for the thread more ready to allow it to slide and at the same time to enable the thread to be wetted, the supply receptacle is, in accordance with the invention, transferred to the stationary part of the spindle so that its lubricant content has no effect on the running of the spindle.

Thus, there is proposed in accordance with the invention a receptacle for lubricant or wetting agent in the base of the protective pot, i.e. in the base of the carrier for the supply package. Into this supply receptacle there preferably projects a member made of absorbent material or material having a capillary structure, which member extends in some suitable fashion to the circumferential face of the stationary sidewall of the protective pot or supply-package carrier over which the thread passes.

The member of absorbent material or material having a capillary structure is preferably in the form of an annulus surrounding the axis of the spindle and which on the one hand projects down into the supply receptacle and which on the other hand passes through a slotted opening to the outside face of the region of the circumferential face over which the thread passes. The thread can rub along this member, which feeds up lubricant or wetting agent, and pass on the lubricant, e.g. a reviving agent or the like, to the other surface areas over which the thread passes.

A member of capillary structure which feeds out the lubricant preferably comprises a porous sintered material, e.g. low-pressure polyethylene, a sintered ceramic, a sintered metal, fritted glass or the like.

Figure 2:
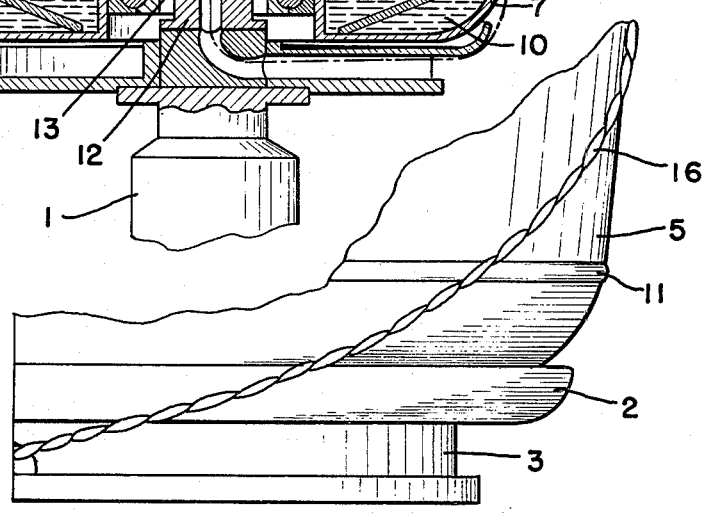

In the accompanying drwwings, which show, by way of example, an embodiment of the invention:

FIG. 1 is an axial section through a two-for-one twisting spindle having a supply receptacle for a lubricant arranged in the base of a protective pot; and FIG. 2 is an elevation on a larger scale, of part of the two-for-one twisting spindle shown in FIG. 1, and shows a lower part of the protective pot.

Referring to the drawings, the two-for-one twisting spindle shown therein comprises a wharve 1, a rotary plate 2 with a thread storage member 3, and a protective pot (supply-package carrier) 4. The protective pot 4 comprises a sidewall 5, a base 7 which supports a paying-out or supply package 6 and which forms the carrier proper for the supply package, and a hollow hub 8. Inset in the sidewall 5 are magnets 9 which co-operate with other magnets (not shown) situated radially opposite to hold the protective pot 4 in position, i.e. to prevent it from rotating. The protective pot 4 is carried on a hollow shaft 12 of the spindle, which can be driven by the wharve 1, with bearings 13, 14 interposed.

The base 7 of the protective pot is in the form of a substantially annular hollow body the interior of which is used as a supply receptacle to hold a lubricant or thread wetting agent 10. Projecting into the cavity holding the lubricant 10 is an annulus 11 of absorbent material or material having a capillary structure. The annulus 11 extends through a circumferential slotted opening 15 in the base, which is in the form of a hollow body, of the protective pot to the outside of the area of circumferential surface over which the thread 16 passes, so that, when the base of the protective pot is filled with lubricant 10 and the spindle is running, the thread 16 which is fed past the outside edge of the annulus 11 is wetted. As the thread travels onward, the lubricant which is continuously picked up by it is passed on to the areas at which it subsequently makes contact with the sidewall 5 of the protective pot and also to other guide surfaces for the thread, thus ensuring optimum and consistent wetting of the thread and the contact surfaces.

Instead of being of annular form, the absorbent or capillary structure means which feeds out the lubricant or wetting agent may also take the form of individual wicks or individual fingers which dip into the lubricant 11 and which, if required, are held together in the region of circumferential surface over which the thread passes by a ring or the like.

I claim:

1. A two-for-one twisting spindle for supporting a thread supply package and having an inside support for a thread balloon comprising; a protective pot enclosing said supply package and having a sidewall, a base and a hollow hub, a stationary supply receptacle having thread lubricant in said protective pot base said protective pot having an outer circumferential thread-engaging surface over which the ballooning thread drawn from said supply package passes during spindle operation whereby lubricant from said supply receptacle is fed to said circumferential surface for contact with said ballooning thread.

2. A two-for-one twisting spindle according to claim 1, said outer circumferential surface over which the thread passes when the spindle is operating is provided with at least one opening.

3. A two-for-one twisting spindle according to claim 2, an absorbent material member, having a capillary structure projecting down into said supply receptacle and passing through said opening.

4. A two-for-one twisting spindle according to claim 3, said absorbent material member has an annulus surrounding said spindle, said annulus passing through said opening in said circumferential surface over which the thread passes whereby a thread contacting said annulus will be lubricated.

* * * * *